US008578562B2

(12) United States Patent
Liu et al.

(10) Patent No.: US 8,578,562 B2
(45) Date of Patent: Nov. 12, 2013

(54) WEIGHT ASSEMBLY FOR A HOSE OF A FAUCET

(75) Inventors: Zhibin Liu, Shen Zen (CN); Weidong Qiu, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 12/858,121

(22) Filed: Aug. 17, 2010

(65) Prior Publication Data

US 2012/0042972 A1 Feb. 23, 2012

(51) Int. Cl.
*E05F 1/00* (2006.01)

(52) U.S. Cl.
USPC ..... 16/400; 16/404; 137/801

(58) Field of Classification Search
USPC ..... 16/400, 404; 482/93, 97, 98; 473/256; 74/61, 89.15, 87, 571.1; 248/76, 80, 248/84; 4/675, 678; 24/136 R, 136 B, 136 K, 24/136 L, 115 M, 115 G, 456, 460, 573.09, 24/573.11, 578.1, 545, 115 F; 137/801, 137/588, 355.12, 355.16, 355.17, 355.23; 138/103, 106, 107; 239/588
See application file for complete search history.

(56) References Cited

U.S. PATENT DOCUMENTS

| | | | | | |
|---|---|---|---|---|---|
| 3,604,069 | A * | 9/1971 | Jensen | 24/332 |
| 4,588,191 | A * | 5/1986 | Stewart | 473/256 |
| 4,872,281 | A * | 10/1989 | Burgess | 43/43.12 |
| 5,311,909 | A * | 5/1994 | Adcock | 137/899 |
| 5,771,934 | A * | 6/1998 | Warshawsky | 137/801 |
| 5,776,006 | A * | 7/1998 | Gruber | 473/256 |
| 5,960,832 | A * | 10/1999 | Warshawsky | 137/801 |
| 6,120,385 | A * | 9/2000 | Nemeckay | 473/256 |
| 6,250,338 | B1 * | 6/2001 | Dempsey | 138/103 |
| 6,460,570 | B1 * | 10/2002 | Jones et al. | 137/801 |
| 6,612,936 | B1 * | 9/2003 | Matias | 473/256 |
| 7,048,640 | B2 * | 5/2006 | Light | 473/256 |
| 7,143,780 | B1 * | 12/2006 | Pitts | 137/382 |

* cited by examiner

*Primary Examiner* — Chuck Y. Mah

(57) ABSTRACT

A weight assembly for a faucet being fixed on a hose and contains a body including an open groove with a first opening, a vertical height of the groove being slightly more that a diameter of the hose, a horizontal depth of the groove along a Y-axis direction being larger than the diameter of the hose; the body including a hole, an upper receiving seat, and a lower receiving seat; a first retaining member received in the hole, the upper and the lower receiving seats, and including an open locking recess with a second opening; the locking recess including a concavely arcuate defining fence; a vertical height of the second opening on the Z-axis direction being equal to or more than the vertical height of the groove; a second retaining member used to screw with a top end of the first retaining member.

12 Claims, 10 Drawing Sheets

WEIGHT ASSEMBLY FOR A HOSE OF A FAUCET

BACKGROUND OF THE INVENTION

1. Field of the Invention

The present invention relates to a weight assembly for a faucet being fixed on a hose.

2. Description of the Prior Art

A conventional spray hose assembly includes a hose and a spray head, and one end of the hose is connected to a water supply source, and another end thereof is coupled to the spray head. In a normal state, the hose is fixed under a tank, and the spray head is positioned in a receiving seat of the tank so that when a user pulls the spray head, the hose extends outward from an opening of the receiving seat. Moreover, a weight assembly is installed on the hose so that the spray head returns back to the receiving seat when in no use by using the weight assembly's weight.

A conventional weight assembly is integrally made and formed in an oval shape, includes a hole to insert and retain a hose, however when the weight assembly is assembled, it has to be fitted from one end of the hose and then moved toward a suitable position along the hose, thus having an inconvenient assembly. For example, when two ends of the hose are connected, the weight assembly is not easy to be removed, and because a size of the hole is fixed, as the hole is in a small size, the weight assembly can not be moved along the hose easily. Even though the weight assembly is capable of being moved along the hose, the hose is deformable and broken easily. While the hole is in a large size, the weight assembly can not be fixed on the hose securely.

Another conventional weight assembly includes two part pieces, each including a groove extending thereon vertically, and the part pieces are connected together by ways of a retaining member with screws, such as a screw bolt, so as to retain a hose between the grooves. Nevertheless, the part pieces have to be aligned with the hose, and then one of the part pieces is inserted by the retaining member to be further screwed in a screwing bore of another part piece, thus connecting the part pieces together. But after the part pieces are connected together, they can not be fixed on the hose directly. In other words, the retaining member has to be removed from the part pieces first so that the part pieces are disassembled from each other, and then the grooves of the part pieces are used to receive the hose so as to have further installing process. While the weight assembly is removed from the hose, the retaining member is removed so that the part pieces are disassembled from each other and removed form the hose further, having time consuming installation.

U.S. Pat. No. 6,460,570 discloses a weight assembly including a body having a plane extending vertically, and including an open groove, a depth of which is more than a half of a diameter of a hose so as to receive the hose, and including a retaining member with inner screws to pass through the groove and to screw with outer screws of the plane of the body so that the weight assembly is fixed on the hose tightly.

However, before fixing or removing the retaining member, it has to be removed form the body or the hose. For example, after the body is fixed on the hose, it has to be screwed with the retaining member further, thus removing and screwing the retaining member repeatedly to cause an inconvenient assembly.

The present invention has arisen to mitigate and/or obviate the afore-described disadvantages.

SUMMARY OF THE INVENTION

The primary object of the present invention is to provide a weight assembly for a faucet that is capable of overcoming the shortcomings of the conventional weight assembly for a faucet.

Further object of the present invention is to provide a weight assembly for a faucet that is installed to the hose without being dissembled its related components in advance, thus having easy and quick installation. Also, the second retaining member is capable of being operated by fingers to obtain easy operation.

Another object of the present invention is to provide a weight assembly for a faucet that is assembled completely before package and is fixed on the hose directly without being disassembled and using any tools to finish installation process quickly.

Also another object of the present invention is to provide a weight assembly for a faucet that is disassembled from the hose quickly by manually rotating the second retaining member, thus replacing and maintaining the weight assembly conveniently.

To obtain the above objectives, a weight assembly for a faucet provided by the present invention contains:

a body including an open groove horizontally extending thereon along a X-axis direction, and the groove including a first opening, a vertical height of the groove being slightly more that a diameter of the hose so that the hose is inserted into the groove, and a horizontal depth of the groove along a Y-axis direction being larger than the diameter of the hose so that the hose is received in the groove completely; the body including a hole vertically arranged along a Z-axis direction to pass through a middle section of the groove; and the body further including an upper receiving seat and a lower receiving seat disposed on a top and a bottom ends thereof along the Z-axis direction respectively, and the hole passing through the upper receiving seat and the lower receiving seat;

a first retaining member received in the hole of the body, the upper receiving seat, and the lower receiving seat, and including an open locking recess mounted on a middle section thereof, the locking recess including a second opening to correspond to the first opening; the locking recess including a concavely arcuate defining fence to match with an outer wall of the hose; a vertical height of the second opening on the Z-axis direction being equal to or more than the vertical height of the groove so that the hose is inserted to the locking recess via the second opening;

a second retaining member used to screw with a top end of the first retaining member so that the first retaining member is actuated to move upward along the Z-axis direction, and the hose is retained between the defining fence of the first retaining member and an inner wall of the groove.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
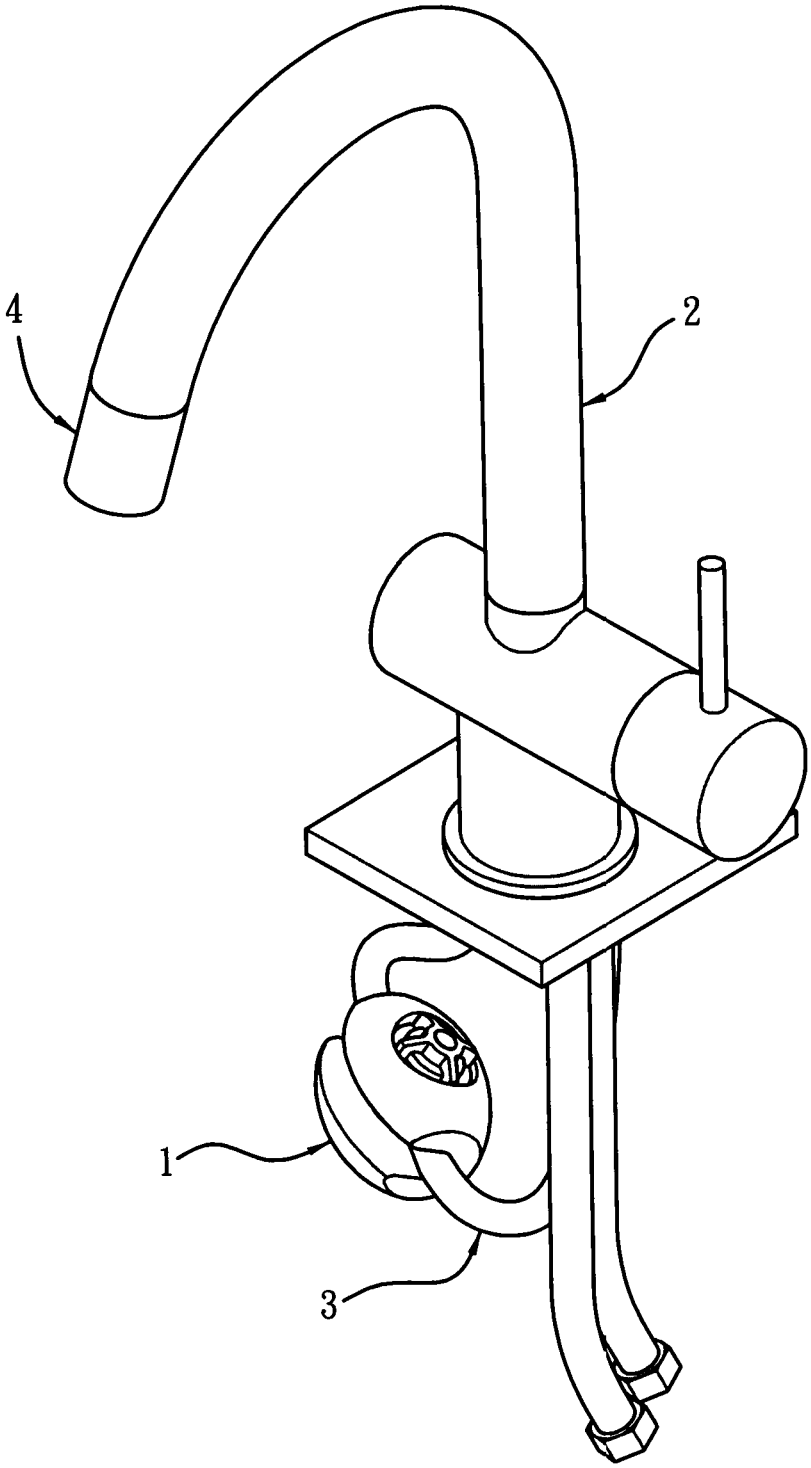
FIG. 1 is a perspective view showing a weight assembly being installed on a hose of a faucet according to a preferred embodiment of the present invention.
Figure 2:
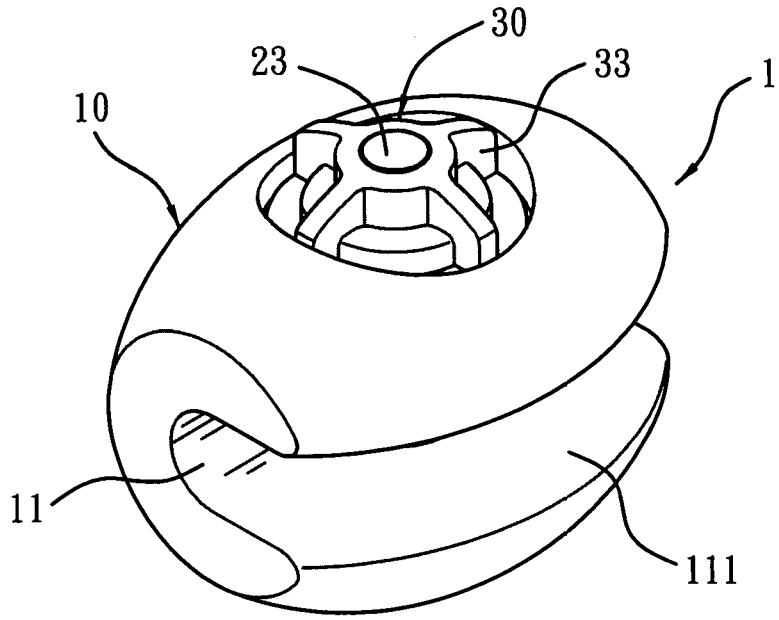
FIG. 2 is a perspective view showing the assembly of the weight assembly for the faucet according to the preferred embodiment of the present invention.
Figure 3:
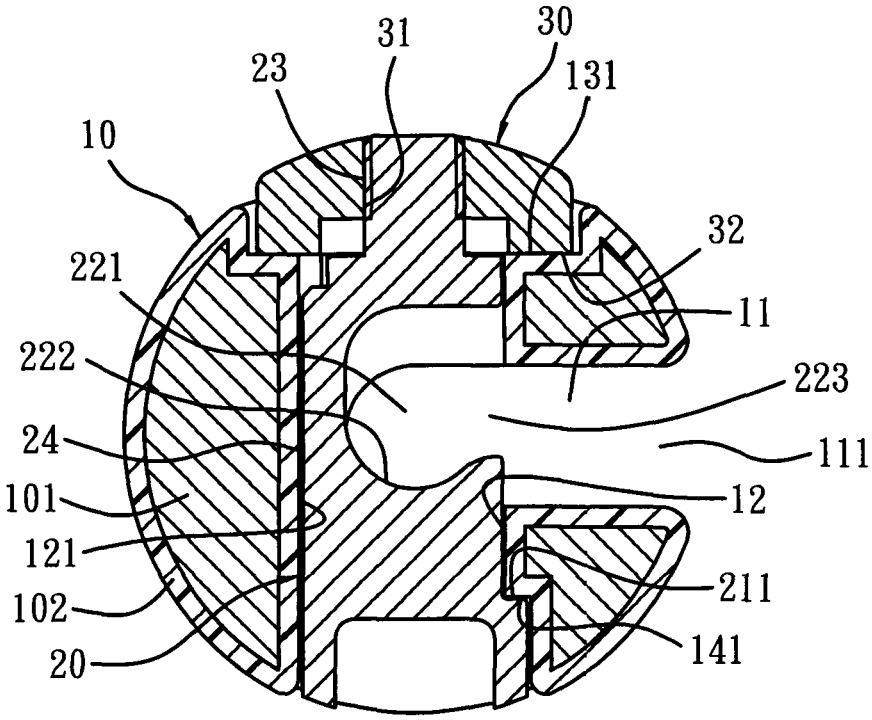
FIG. 3 is a cross sectional view showing the assembly of the weight assembly for the faucet according to the preferred embodiment of the present invention.
Figure 4:
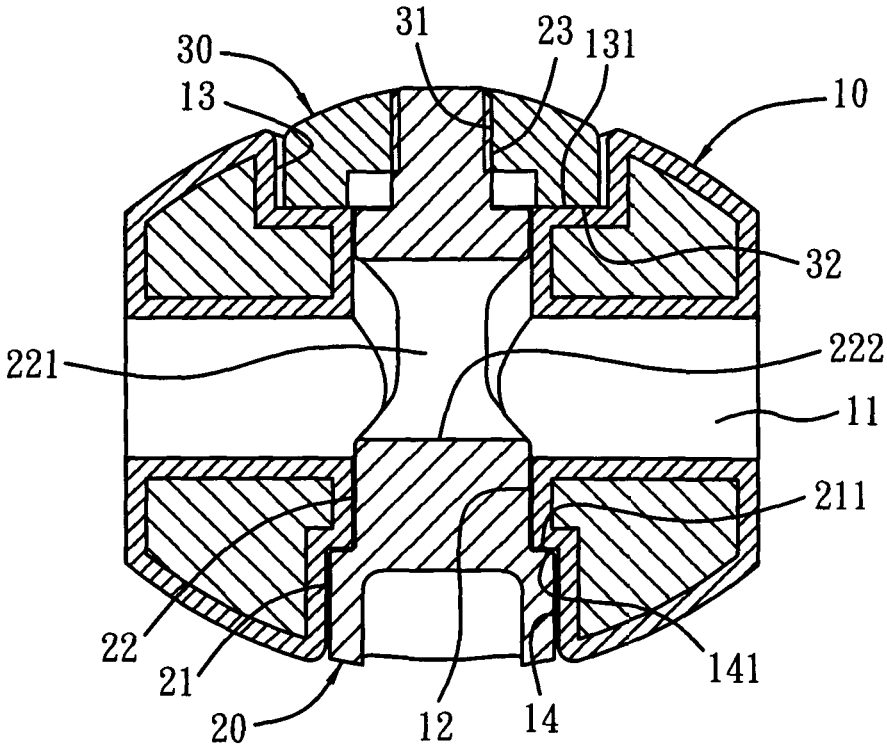
FIG. 4 is another cross sectional view showing the assembly of the weight assembly for the faucet according to the preferred embodiment of the present invention.
Figure 5:
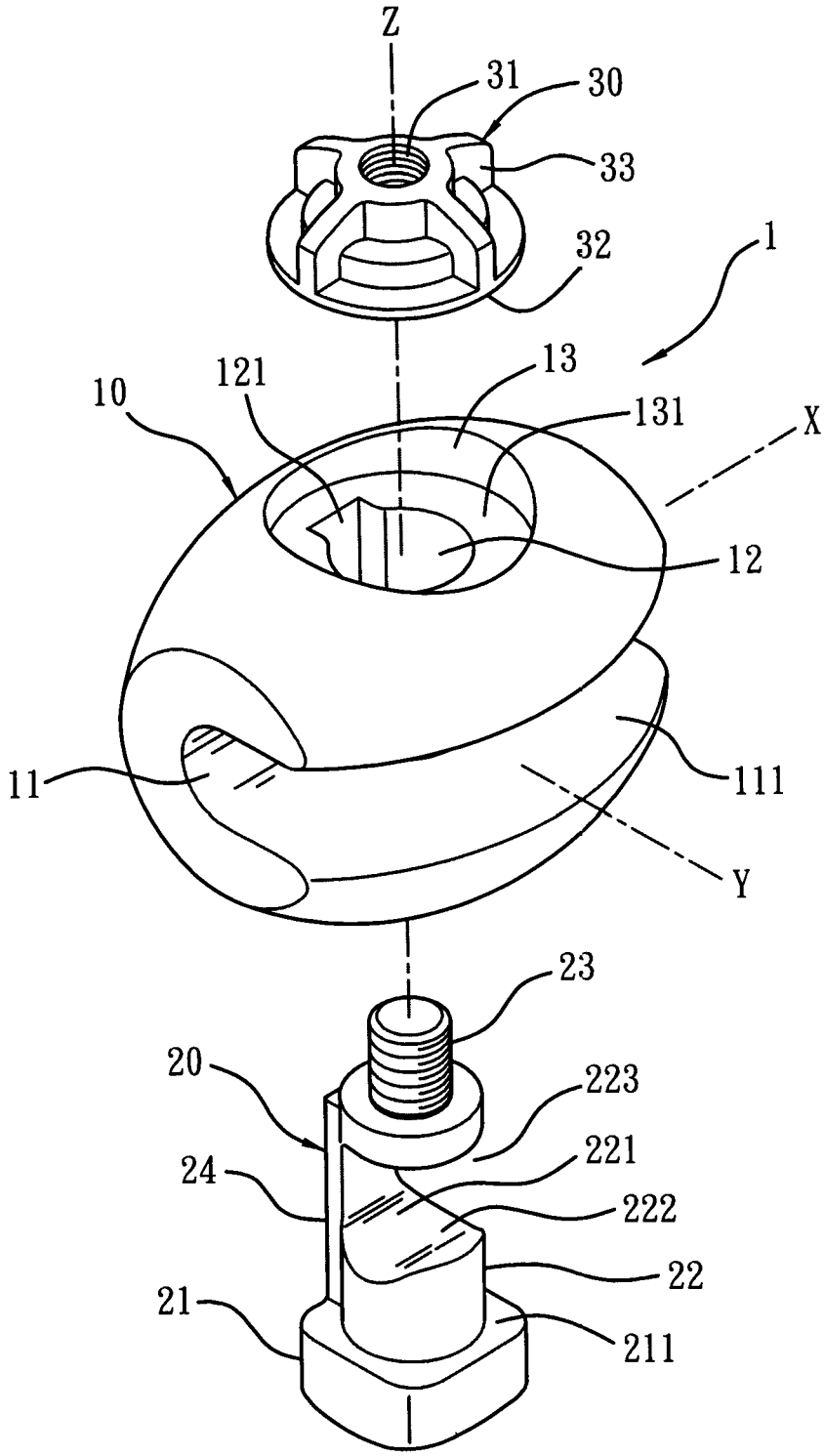
FIG. 5 is a perspective view showing the exploded components of the weight assembly for the faucet according to the preferred embodiment of the present invention.

Referring to FIG. 1, a weight assembly 1 for a faucet 2 according to a preferred embodiment of the present invention is fixed on a hose 3 of the faucet 2, and the hose 3 includes a spray member 4 connected therewith so that water sprays out of the spray member 4 via the hose 3.

As shown in FIGS. 2-5, the weight assembly 1 includes a body 10, a first retaining member 20, and a second retaining member 30.

The body 10 is formed in an oval shape and includes an open groove 11 horizontally extending thereon along a X-axis direction, and a depth of the groove 11 is more than ½ of width of the body 10 on a Y-axis direction, and the groove 11 includes a vertical height along a Z-axis direction, any positions of the vertical height on the X-axis direction are equal.

Figure 9:
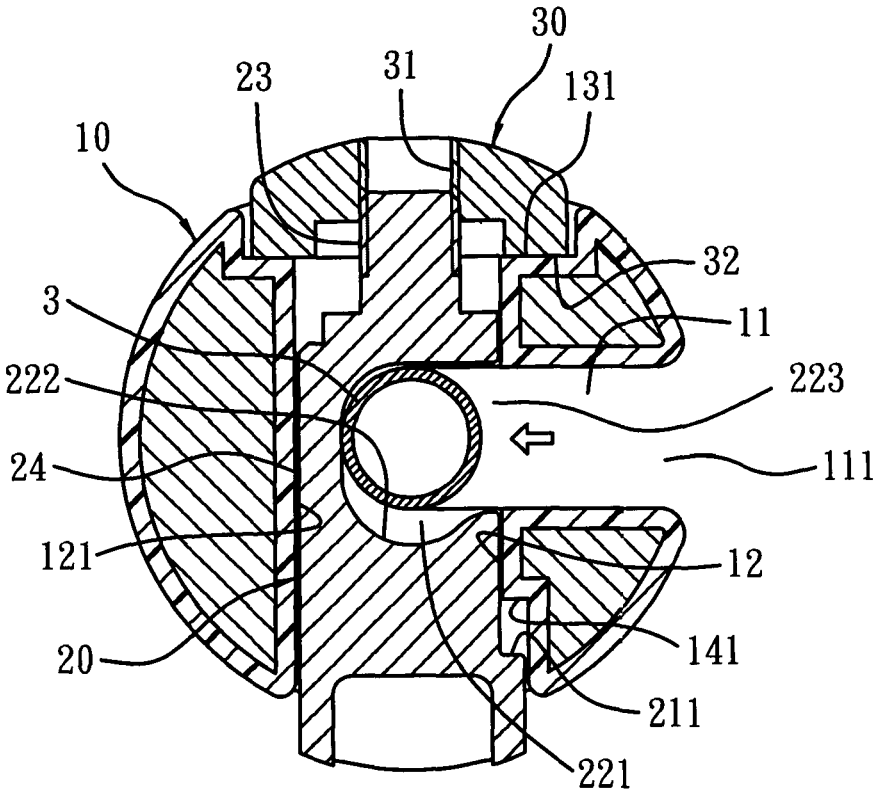
FIG. 9 is a cross sectional view showing the operation of the weight assembly for the faucet according to the preferred embodiment of the present invention.

The groove 11 includes an elongated first opening 111, and the vertical height of the groove 11 is slightly more that a diameter of the hose 3 so that the hose 3 is inserted into the groove 11 as illustrated in FIG. 9, but a horizontal depth of the groove 11 along the Y-axis direction is larger than the diameter of the hose 3 so that the hose 3 is received in the groove 11 completely. In this embodiment, the horizontal depth of the groove 11 along the Y-axis direction is more that 1.5 times of the diameter of the hose 3, e.g. the horizontal depth of the groove 11 along the Y-axis direction is 2.5 times larger that the diameter of the hose 3.

An inner wall of the groove 11 on the Y-axis direction is formed in a concave arc shape to contact with a semicircular outer wall of the hose 3 as illustrated in FIG. 9.

Figure 6:
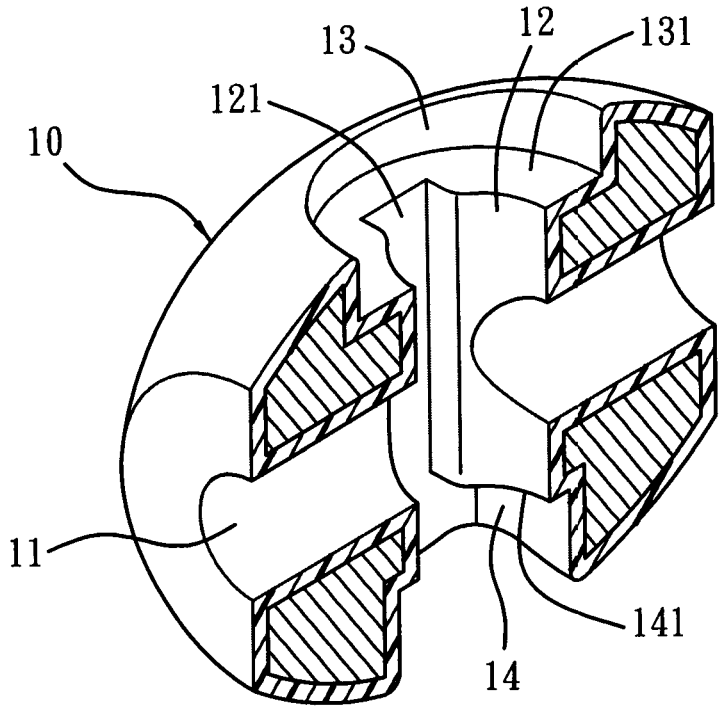
FIG. 6 is a cross-sectional perspective view showing the assembly of the weight assembly for the faucet according to the preferred embodiment of the present invention.
Figure 7:
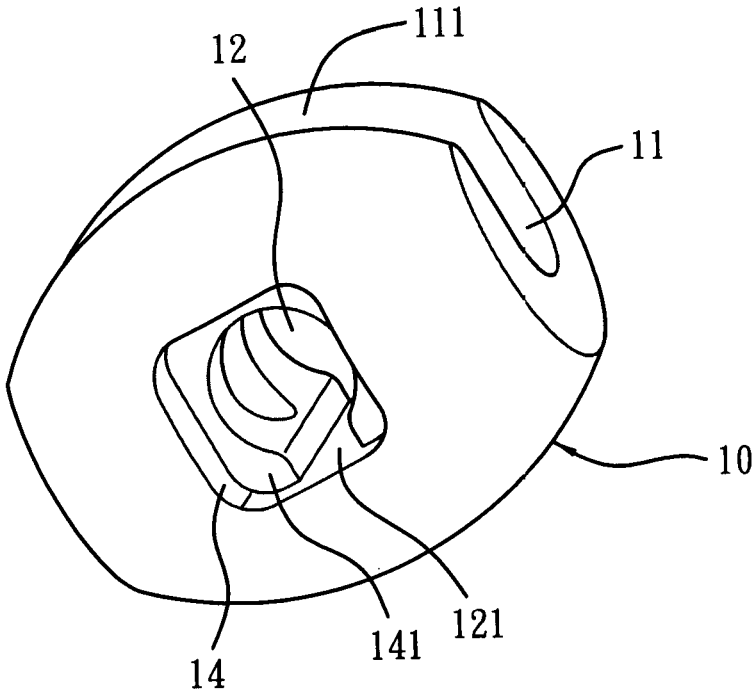
FIG. 7 is another perspective view showing the assembly of the weight assembly for the faucet according to the preferred embodiment of the present invention.

With reference to FIGS. 6 and 7, the body 10 includes a key-shaped hole 12 vertically arranged along the Z-axis direction, wherein a part of the hole 12 passes through a middle section of the groove 11, and a diameter of the hole 12 is more that an innermost portion of the groove 11 on the Y-axis direction so that the hole 12 includes a longitudinal slot 121 formed therein to provide guiding and limiting functions.

The body 10 further includes an upper receiving seat 13 and a lower receiving seat 14 disposed on a top and a bottom ends thereof along the Z-axis direction respectively, and the hole 12 passes through middle sections of the upper receiving seat 13 and the lower receiving seat 14, the upper receiving seat 13 includes an annular first stopping fringe 131 defined on a top wall thereof, and the lower receiving seat 14 includes a U-shaped second stopping fringe 141 defined on a top wall thereof.

In this embodiment, the upper receiving seat 13 is formed in a circular groove shape, and the lower receiving seat 14 is formed in a rectangle shape to provide a limiting function, but the shape of the lower receiving seat 14 is not limited, e.g., the lower receiving seat 14 is capable of being formed in any shape, such as a non-circle shape, to obtain the limiting function.

The body 10 is made of a metal material 101 and includes a rubber material 102 covered thereon, however, the body 10 also allows to be covered by the metal material.

The first retaining member 20 is received in the hole 12 of the body 10, the upper receiving seat 13, and the lower receiving seat 14, and formed in a column shape, and includes a limiting segment 21 formed in a rectangular block shape to retain with the lower receiving seat 14 so that the first retaining member 20 is limited without rotating. Of course, the shape of the limiting segment 21 is not limited, e.g., the limiting segment 21 is capable of being formed in any shape, such as a non-circular block shape, to retain with the lower receiving seat 14.

Figure 10:
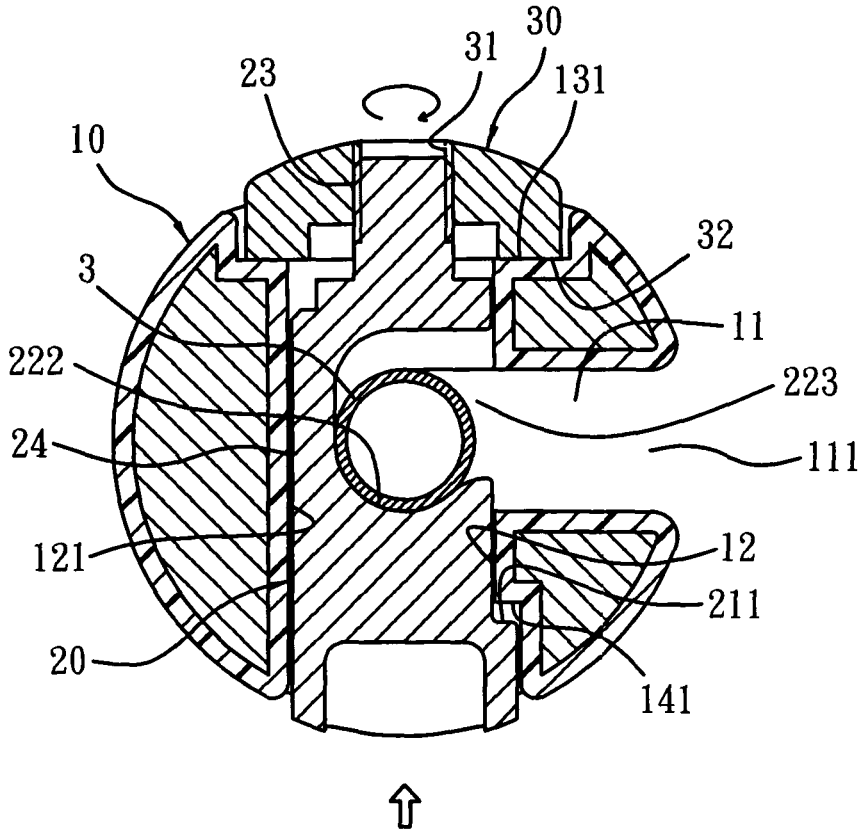
FIG. 10 is another cross sectional view showing the operation of the weight assembly for the faucet according to the preferred embodiment of the present invention.
Figure 11:
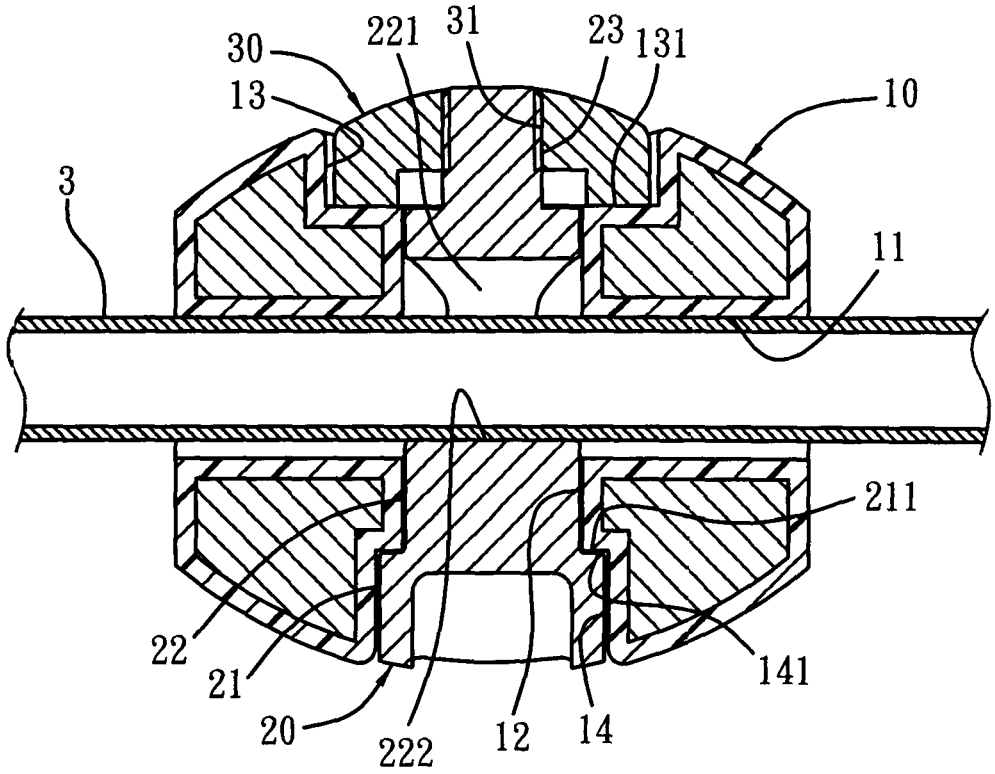
FIG. 11 is another cross sectional view showing the operation of the weight assembly for the faucet according to the preferred embodiment of the present invention.

The limiting segment 21 includes a column-shaped engaging portion 22 extending from a top end thereof, and the column-shaped engaging portion 22 includes an open locking recess 221 mounted on a middle section thereof, the locking recess 221 includes a concavely arcuate defining fence 222 to match with the outer wall of the hose 3 as shown in FIG. 10. The locking recess 221 further includes a narrow second opening 223 to correspond to the first opening 111, and a vertical height of the second opening 223 on the Z-axis direction is equal to or more than the vertical height of the groove 11 so that the hose 3 is inserted to the locking recess 221 via the second opening 223 as shown in FIG. 9.

The limiting segment 21 of the first retaining member 20 includes a restraining fence 211 by using a top wall of the engaging portion 22 to abut against the second stopping fringe 141 of the body 10 upward so that the first retaining 20 is limited without moving upward.

The engaging portion 22 of the first retaining member 20 includes a screw pillar 23 extending into the upper receiving seat 13 of the body 10 from a top end thereof.

Figure 8:
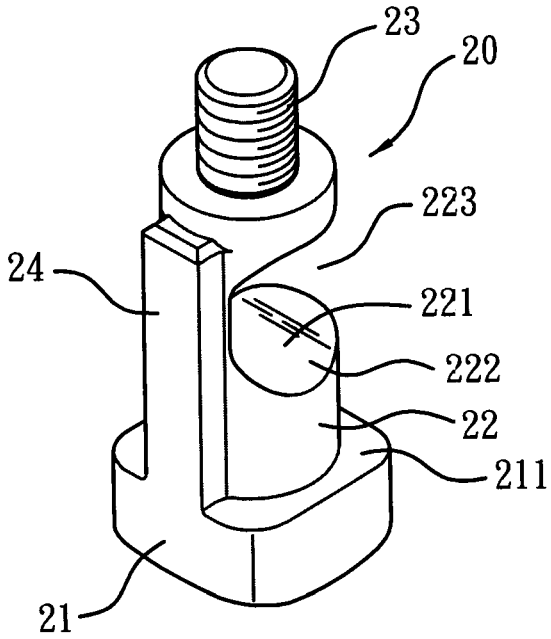
FIG. 8 is a perspective view showing the assembly of a first retaining member of the weight assembly for the faucet according to the preferred embodiment of the present invention.

The engaging portion 22 of the first retaining member 20 includes a sliding block 24 vertically extending on another side thereof relative to the second opening 223 along the Z-axis direction as shown in FIG. 8 so as to slide in the slot 121 of the body 10 along the Z-axis direction to limit the first retaining member 20 to rotate in the body 10. Thereby, the first retaining member 20 is limited without rotation by ways of the limiting segment 21, the lower receiving seat 14, the sliding block 24, and the slot 121.

The second retaining member 30 includes a bore 31 to screw with the screw pillar 23 of the first retaining member 20, when the second retaining member 30 retains with the first retaining member 20, the first retaining member 20 moves upward along the Z-axis direction, the hose 3 is retained between the defining fence 222 of the first retaining member 20 and the inner wall of the groove 11 as illustrated in FIG. 10.

The second retaining member 30 includes a circular abutting rim 32 to abut against the first stopping fringe 131 of the upper receiving seat 13 as the hose 3 is retained tightly.

The second retaining member 30 includes a plurality of ribs 33 arranged on a top end thereof to be rotated by user's fingers. In this embodiment, there are four ribs provided on the top end of the second retaining member 30 to form a rotable knob so that the user rotates the second retaining member 30 without using any tools easily to fix the hose 3.

The weight assembly 1 is installed at a suitable position of the hose 3, and before installing the weight assembly 1 on the hose 3, the body 10, the first and the second retaining members 20, 30 are assembled together in advance, and during installing process, the first retaining member 20 is fixed on a vertical position of the body 10 along the Z-axis direction, if the second opening 223 is located at the vertical position of the body 10 along the Z-axis direction, the hose 3 is capable of being inserted into the locking recess 221 via the first opening 111 of the body 10, and then the first retaining member 20 is rotated tightly by user's fingers after confirming the hose's position, so that the hose 3 is retained between the defining fence 222 of the first retaining member 20 and the inner wall of the groove 11, thus finishing an installation of the weight assembly 1.

If the second opening 223 is located between the defining fence 222 of the first retaining member 20 and the inner wall of the groove 11, the hose 3 can not be inserted into the locking recess 221 from the second opening 223, and the second retaining member 30 is rotated releasably so that the first retaining member 20 moves upward along the Z-axis direction, wherein when a bottom end of the second opening 223 of the first retaining member 20 is equal to or lower than a bottom end of the groove 11, the hose 3 is capable of being inserted into the locking recess 221 via the second opening 223 to rotate the second retaining member 30 tightly.

It is to be noted that the concave arc-shaped inner wall of the groove 11 and the concavely arcuate defining fence 222 of the first retaining member 20 are used to retain the hose 3, and the hose 3 is not deformable. For example, after the weight assembly 1 is installed on the hose 3 as shown in FIG. 10, the hose 3 is retained between the concave arc-shaped inner wall of the groove 11 and the concavely arcuate defining fence 222 without deformation.

Thereby, the weight assembly 1 is installed to the hose 3 without being dissembled its related components in advance, thus having easy and quick installation. Also, the second retaining member 30 is capable of being operated by fingers to obtain easy operation.

Therefore, the weight assembly 1 is assembled completely before package and is fixed on the hose 3 directly without being disassembled and using any tools to finish installation process quickly.

Likewise, the weight assembly 1 is disassembled from the hose 3 quickly by manually rotating the second retaining member 30, thus replacing and maintaining the weight assembly 1 conveniently.

The second retaining member 30 is a rotable screw element to screw with the screw pillar 23 of the first retaining member 20 in this embodiment, however, any type of connection with the top end of the first retaining member 20 and engagement with the first retaining member 20 to retain the hose 3 are allowed to be embodied in this present invention.

While we have shown and described various embodiments in accordance with the present invention, it is clear to those skilled in the art that further embodiments may be made without departing from the scope of the present invention.

What is claimed is:

1. A weight assembly for a faucet, being fixed on a hose and comprising:

a body including an open groove horizontally extending thereon along a X-axis direction, and the groove including a first opening, a vertical height of the groove being slightly more that a diameter of the hose so that the hose is insertable into the groove, and a horizontal depth of the groove along a Y-axis direction being larger than the diameter of the hose so that the hose is received in the groove completely; the body including a hole vertically arranged along a Z-axis direction to pass through a middle section of the groove; and the body further including an upper receiving seat and a lower receiving seat disposed on a top and a bottom ends thereof along the Z-axis direction respectively, and the hole passing through the upper receiving seat and the lower receiving seat;

a first retaining member received in the hole of the body, the upper receiving seat, and the lower receiving seat, said first retaining member including an open locking recess disposed on a middle section thereof, the locking recess including a second opening to correspond to the first opening; the locking recess including a concavely arcuate defining fence to match with an outer wall of the hose; a vertical height of the second opening on the Z-axis direction being equal to or greater than the vertical height of the groove so that the hose is insertable to the locking recess via the second opening;

a second retaining member used to screw with a screw pillar top end of the first retaining member disposed in the upper receiving seat so that the first retaining member is actuated to move upward along the Z-axis direction, and the hose is retained between the defining fence of the first retaining member and an inner wall of the groove.

2. The weight assembly as claimed in claim 1, wherein the depth of the groove is more than ½ the width of the body on the Y-axis direction and is at least 1.5 times of the diameter of the hose.

3. The weight assembly as claimed in claim 2, wherein the depth of the groove is 2.5 times larger that the diameter of the hose.

4. The weight assembly as claimed in claim 1, wherein the inner wall of the groove extends on the X-axis direction and is formed in a concave arc shape to contact with a semicircular outer wall of the hose.

5. The weight assembly as claimed in claim 1, wherein the first retaining member includes a limiting segment to retain with the lower receiving seat so that the first retaining member is limited without rotating, an engaging portion extending from a top end of the limiting segment, the engaging portion includes the locking recess, and the screw pillar extends into the upper receiving seat of the body to screw with a threaded bore of the second retaining member.

6. The weight assembly as claimed in claim 5, wherein the lower receiving seat is formed in a non-circle shape, and the limiting segment is formed in a non-circular block shape to correspond to the shape of the lower receiving seat.

7. The weight assembly as claimed in claim 6, wherein the non-circular shape of the lower receiving seat is formed in a rectangle shape, and the non-circular shape of the limiting segment is formed in a rectangular block shape to correspond to the shape of the lower receiving seat.

8. The weight assembly as claimed in claim 5, wherein the lower receiving seat includes a stopping fringe defined on a top wall thereof; The limiting segment of the first retaining member includes a top wall to abut against the stopping fringe so that the first retaining member is limited without moving upward.

9. The weight assembly as claimed in claim 5, wherein the hole is formed in a key shape and includes a longitudinal slot formed therein; the engaging portion of the first retaining member includes a sliding block vertically extending along the Z-axis direction so as to slide in the slot.

10. The weight assembly as claimed in claim 1, wherein the upper receiving seat includes an annular stopping fringe defined on a top wall thereof, and the second retaining member includes a circular abutting rim to abut against the stopping fringe of the upper receiving seat as the and the second retaining members retain with each other.

11. The weight assembly as claimed in claim 1, wherein the second retaining member includes a plurality of ribs arranged on a top end thereof to be rotated by user's fingers.

12. The weight assembly as claimed in claim 1, wherein the second retaining member is a rotable knob so that the user rotates the second retaining member with fingers.

* * * * *